US007988025B2

(12) United States Patent
Terrell

(10) Patent No.: US 7,988,025 B2
(45) Date of Patent: Aug. 2, 2011

(54) PNEUMATIC FASTENER

(75) Inventor: Timothy E. Terrell, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 1285 days.

(21) Appl. No.: 11/064,764

(22) Filed: Feb. 24, 2005

(65) Prior Publication Data

US 2005/0189394 A1 Sep. 1, 2005

Related U.S. Application Data

(60) Provisional application No. 60/547,662, filed on Feb. 24, 2004.

(51) Int. Cl.
*B25C 1/041* (2006.01)

(52) U.S. Cl. ..... 227/119; 227/120; 227/130

(58) Field of Classification Search ..... 227/8, 119, 227/120, 130, 131
See application file for complete search history.

(56) References Cited

U.S. PATENT DOCUMENTS

| | | | | |
|---|---|---|---|---|
| 3,232,511 | A | 2/1966 | Crooks | 227/130 |
| 3,320,860 | A | 5/1967 | Bade | 91/461 |
| 3,351,256 | A | 11/1967 | Readyhough | 227/130 |
| 3,398,648 | A | 8/1968 | Cairatti | 91/417 |
| 3,438,449 | A | 4/1969 | Smith | 173/17 |
| 3,464,614 | A | 9/1969 | Volkmann | 227/130 |
| 3,496,840 | A | 2/1970 | Wandel et al. | 92/85 |
| 3,498,517 | A | 3/1970 | Novak | 227/8 |
| 3,527,142 | A | 9/1970 | Obergfell | 91/461 |
| 3,568,909 | A | 3/1971 | Perkins | 227/130 |
| 3,622,062 | A | 11/1971 | Goode, Jr. et al. | 227/130 |
| 3,657,968 | A | 4/1972 | Lange | 91/398 |
| 3,708,095 | A | 1/1973 | Briggs, Jr. | 227/126 |

(Continued)

FOREIGN PATENT DOCUMENTS

DE 1935783 7/1969

(Continued)

OTHER PUBLICATIONS

Porter-Cable "Round Head Framing Nailer, FR350A," Part No. 910442; © 2005 Porter-Cable Corporation.

(Continued)

*Primary Examiner* — Rinaldi I Rada
*Assistant Examiner* — Nathaniel Chukwurah
(74) *Attorney, Agent, or Firm* — Rhonda L. Barton; Scott B. Markow; Adan Ayala

(57) ABSTRACT

A nose casting assembly for a pneumatic fastener includes a body having a driver channel formed therein for receiving a driver blade. The body includes a first end having an aperture for allowing passage of a driver blade into the channel. The body further includes a second end configured for allowing a fastener to be expelled from the nose casting assembly. The body further includes an exterior surface and an interior surface, the interior surface having a loading aperture formed therein for allowing passage of a fastener into the driver channel. Additionally, the interior surface includes a nose casting groove formed therein, the nose casting groove extending linearly along the interior surface of the body towards the second end of the body, wherein the nose casting groove is configured for receiving the shank of a fastener being utilized with the pneumatic fastener for preventing the fastener from becoming wedged between the driver blade and the interior surface of the nose casting assembly when a shank of a fastener is oriented toward the driver blade.

20 Claims, 9 Drawing Sheets

U.S. PATENT DOCUMENTS

| | | | | |
|---|---|---|---|---|
| 3,708,096 | A | 1/1973 | Burke, Jr. | 227/130 |
| 3,715,069 | A | 2/1973 | O'Conner | 227/130 |
| 3,774,293 | A | 11/1973 | Golsch | 29/432.1 |
| 3,788,195 | A | 1/1974 | Lange | 91/457 |
| 3,797,723 | A | 3/1974 | Perkins et al. | 227/109 |
| 3,895,562 | A | 7/1975 | El Guindy | 91/308 |
| 3,901,130 | A | 8/1975 | Lange | 91/461 |
| 3,905,535 | A | 9/1975 | Novak et al. | 227/120 |
| 4,030,655 | A | 6/1977 | Rothfuss et al. | 227/130 |
| 4,039,113 | A | 8/1977 | Males | 227/130 |
| 4,053,093 | A | 10/1977 | Thueringer | 227/5 |
| 4,053,094 | A | 10/1977 | Males | 227/93 |
| 4,117,767 | A | 10/1978 | Elliesen | 91/461 |
| 4,197,886 | A * | 4/1980 | MacDonald | 81/442 |
| 4,294,391 | A | 10/1981 | Obergfell | 227/130 |
| 4,480,528 | A | 11/1984 | Shiroyama | 91/461 |
| 4,784,308 | A | 11/1988 | Novak et al. | 227/130 |
| 4,932,480 | A | 6/1990 | Golsch | 173/139 |
| 4,986,164 | A | 1/1991 | Crutcher | 91/461 |
| 5,014,898 | A | 5/1991 | Heidrich | 227/130 |
| 5,020,712 | A | 6/1991 | Monacelli | 227/8 |
| 5,025,971 | A | 6/1991 | Schafer et al. | 227/156 |
| 5,110,030 | A | 5/1992 | Tanji | 227/130 |
| 5,131,579 | A | 7/1992 | Okushima et al. | 227/8 |
| 5,207,143 | A | 5/1993 | Monacelli | 91/442 |
| 5,217,153 | A | 6/1993 | Yamamoto et al. | 227/130 |
| 5,238,167 | A | 8/1993 | Howard et al. | |
| 5,259,465 | A | 11/1993 | Mukoyama | 173/168 |
| 5,261,587 | A | 11/1993 | Robinson | 227/8 |
| 5,273,200 | A | 12/1993 | Hoefler | 227/136 |
| D353,664 | S | 12/1994 | Eminger et al. | D8/69 |
| 5,437,339 | A | 8/1995 | Tanaka | 173/210 |
| 5,452,835 | A | 9/1995 | Shkolnikov | 227/8 |
| D379,912 | S | 6/1997 | Burke et al. | D8/68 |
| 5,637,125 | A | 6/1997 | Amada | 55/385.1 |
| 5,647,525 | A | 7/1997 | Ishizawa | 227/113 |
| D383,657 | S | 9/1997 | Kaiser | D8/69 |
| 5,671,880 | A | 9/1997 | Ronconi | 227/130 |
| 5,706,996 | A | 1/1998 | Lee | 227/130 |
| 5,709,332 | A | 1/1998 | Coop | 227/66 |
| 5,720,422 | A | 2/1998 | Ichikawa et al. | 227/120 |
| 5,725,142 | A | 3/1998 | Hamada | 227/130 |
| 5,732,870 | A | 3/1998 | Moorman et al. | 227/130 |
| 5,758,812 | A * | 6/1998 | Raffoni | 227/120 |
| 5,829,660 | A | 11/1998 | White | 227/8 |
| 5,850,961 | A | 12/1998 | Braun et al. | 227/130 |
| 5,873,510 | A | 2/1999 | Hirai et al. | 227/130 |
| 5,881,941 | A | 3/1999 | Lai | 227/130 |
| 5,918,788 | A | 7/1999 | Moorman et al. | 227/8 |
| 5,927,584 | A | 7/1999 | Akiba | 227/130 |
| 6,024,269 | A | 2/2000 | Ho et al. | 227/130 |
| 6,039,231 | A | 3/2000 | White | 227/130 |
| 6,041,992 | A | 3/2000 | Poinelli et al. | 227/130 |
| 6,059,166 | A | 5/2000 | Ho et al. | 227/130 |
| 6,059,167 | A | 5/2000 | Ho et al. | 227/130 |
| 6,079,605 | A | 6/2000 | Braun et al. | 227/130 |
| 6,087,436 | A | 7/2000 | Larrow et al. | 524/517 |
| D433,908 | S | 11/2000 | Kaiser | D8/69 |
| D435,769 | S | 1/2001 | Etter et al. | D8/68 |
| 6,173,963 | B1 | 1/2001 | Ho et al. | 277/361 |
| 6,186,386 | B1 | 2/2001 | Canlas et al. | 227/142 |
| 6,189,759 | B1 | 2/2001 | Canlas et al. | 227/120 |
| 6,220,496 | B1 | 4/2001 | Hirai et al. | 227/130 |
| D442,453 | S | 5/2001 | Etter et al. | D8/70 |
| 6,371,348 | B1 | 4/2002 | Canlas et al. | 227/8 |
| 6,382,492 | B1 | 5/2002 | Moorman et al. | 227/8 |
| 6,394,332 | B2 | 5/2002 | Akiba | 227/8 |
| 6,431,425 | B1 | 8/2002 | Moorman et al. | 227/8 |
| D463,964 | S | 10/2002 | Oh | D8/70 |
| 6,488,195 | B2 * | 12/2002 | White et al. | 227/130 |
| 6,572,000 | B2 | 6/2003 | Hirai et al. | 227/130 |
| 6,626,081 | B2 | 9/2003 | Ho et al. | 91/394 |
| 6,648,202 | B2 | 11/2003 | Miller et al. | 227/130 |
| 6,783,044 | B2 | 8/2004 | Perra et al. | 227/8 |
| 6,808,101 | B2 * | 10/2004 | Laubach et al. | 227/109 |
| 2001/0004084 | A1 | 6/2001 | Hirai et al. | 227/130 |
| 2001/0017311 | A1 | 8/2001 | Hamano et al. | 227/120 |
| 2001/0048016 | A1 | 12/2001 | Akiba | 227/8 |
| 2003/0052152 | A1 | 3/2003 | Hamada | 227/120 |
| 2004/0182908 | A1 * | 9/2004 | Farrell et al. | 227/119 |

FOREIGN PATENT DOCUMENTS

| | | |
|---|---|---|
| DE | 3308698 | 3/1983 |
| DE | 19637203 | 9/1996 |
| EP | 0720892 | 7/1996 |
| EP | 0778109 | 6/1997 |
| GB | 2134027 | 8/1984 |
| JP | 63306518 | 12/1988 |
| JP | 2-152775 | 6/1990 |
| JP | 2-198775 | 8/1990 |
| JP | 5-131378 | 5/1993 |
| JP | 5-138548 | 6/1993 |
| JP | 6-79644 | 3/1994 |
| JP | 07236542 | 9/1995 |
| JP | 09109059 | 4/1997 |
| JP | 10108164 | 4/1998 |
| JP | 10-128681 | 5/1998 |
| JP | 11-179677 | 7/1999 |
| JP | 2000-263466 | 9/2000 |
| JP | 2001-96472 | 4/2001 |
| JP | 2001-162555 | 6/2001 |
| JP | 2001-328078 | 11/2001 |
| JP | 2002-127038 | 5/2002 |

OTHER PUBLICATIONS

Search Report—European Patent Office for related application EP05723613.

* cited by examiner

PNEUMATIC FASTENER

CROSS-REFERENCE TO RELATED APPLICATIONS

The present application claims priority under 35 U.S.C. §119(e) to U.S. Provisional Application No. 60/547,662 entitled: Pneumatic Fastener filed Feb. 24, 2004, which is hereby incorporated by reference in its entirety.

FIELD OF THE INVENTION

The present invention generally relates to the field of pneumatic tools, and particularly to pneumatic fasteners.

BACKGROUND OF THE INVENTION

Pneumatic fasteners, such as brad nailers, finishing nailers, framing nailers, staplers and roofing nailers are widely used within both the construction and woodworking industries. However, during operation of current pneumatic fasteners, such as a roofing coil nailer, a fastener, such as a nail, may be loaded into a driver channel improperly. For instance, when the last nail of a coil of nails is loaded into the driver channel of the nose casting assembly, there may be nothing holding the nail in its correct position within the channel. Consequently, the last nail becomes inverted from a desired orientation within the channel of the nose casting assembly. Thus, when the driver blade fires through the driver channel, the driver blade may engage against the nail shank instead of the head of the nail. This engagement with the nail shank may cause the nail to become wedged within the channel between the driver blade and a wall of the nose casting assembly. Such wedging is problematic in that users may inadvertently damage the nose casting assembly by improperly removing the nail. It would be advantageous to have a pneumatic fastener having a nose casting assembly configured to prevent fasteners from becoming wedged or jammed.

Pneumatic fasteners further include valve assemblies for delivering air to a piston for driving the driver blade. However, current pneumatic fastener valve assemblies have a tendency to stick, due to pressure build-up within the valve assembly, thereby decreasing driving efficiency. Current valve assemblies may require exhaust ports or holes to be machined into the valve assembly to alleviate pressure build-up. It would be advantageous to have a pneumatic fastener having a valve assembly which reduced the profile and increased the efficiency of the pneumatic fastener by alleviating pressure buildup, without the added expense and inconvenience of having to machine vent holes into the valve assembly.

Current pneumatic fasteners may have difficulty when attempting to drive a fastener into a workpiece at severe angles or when the pneumatic fastener is being maneuvered in close quarters. For instance, when securing a fastener into a molding, it is often the case that users wish to drive nails at various angles into the molding. When implemented in such a situation, a pneumatic fastener, such as a finishing nailer, may be prevented from correctly counter-sinking a nail into these locations. Further, marring of the surface of the workpiece by the nose casting assembly may occur when trying to maneuver current pneumatic fasteners in close quarters. It would be advantageous to have a pneumatic fastener with increased maneuverability in close quarters, which does not damage a workpiece.

SUMMARY OF THE INVENTION

Accordingly, a first aspect of the present invention is directed to a pneumatic fastener including a housing, a nose casting assembly and a driver blade. The nose casting assembly includes a body having a driver channel formed therein for receiving the driver blade. The body includes a first end coupled to the housing, the first end including an aperture for allowing passage of the driver blade for driving a fastener into the driver channel. The body further includes a second end configured for allowing a fastener to be expelled from the nose casting assembly. Additionally, the body includes an exterior surface and an interior surface, the interior surface having a loading aperture formed therein for allowing passage of a fastener into the driver channel. The interior surface further includes a nose casting groove formed therein, the nose casting groove extending linearly along the interior surface of the body towards the second end of the body. The driver blade is coupled with a piston, the piston substantially contained within the housing. The driver blade is configured for moving bi-directionally within the driver channel via the aperture of the first end of the body of the nose casting assembly. The driver blade moves axially along an axis extending through the housing and the driver channel. The nose casting groove is sized for receiving the shank of a fastener being utilized with the pneumatic fastener for preventing the fastener from becoming wedged between the driver blade and the interior surface of the nose casting assembly should improper nail positioning occur.

Another aspect of the invention is directed to a pneumatic fastener which further includes a valve assembly. The valve assembly is at least substantially contained within the housing for delivering air to a piston for driving a driver blade. Further, the valve assembly includes a poppet firing valve piston coupled with a split guide ring, the split guide ring configured for allowing pressurized air to be vented from the valve assembly.

A further aspect of the invention is directed to a pneumatic fastener which further includes a tip assembly. The tip assembly includes a mount member having a mount receiver for receiving a fastener. The tip assembly further includes an extension member coupled with the mount member. Additionally, the tip assembly includes a tip for contacting a work surface, the tip being coupled with the extension member. Further included is a sleeve having a sleeve receiver for receiving a fastener, wherein the sleeve is configured for removably coupling with the nose casting assembly. The mount member is configured for insertion within the sleeve so that the mount receiver and sleeve receiver align for receiving a fastener for securing the mount member within the sleeve.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
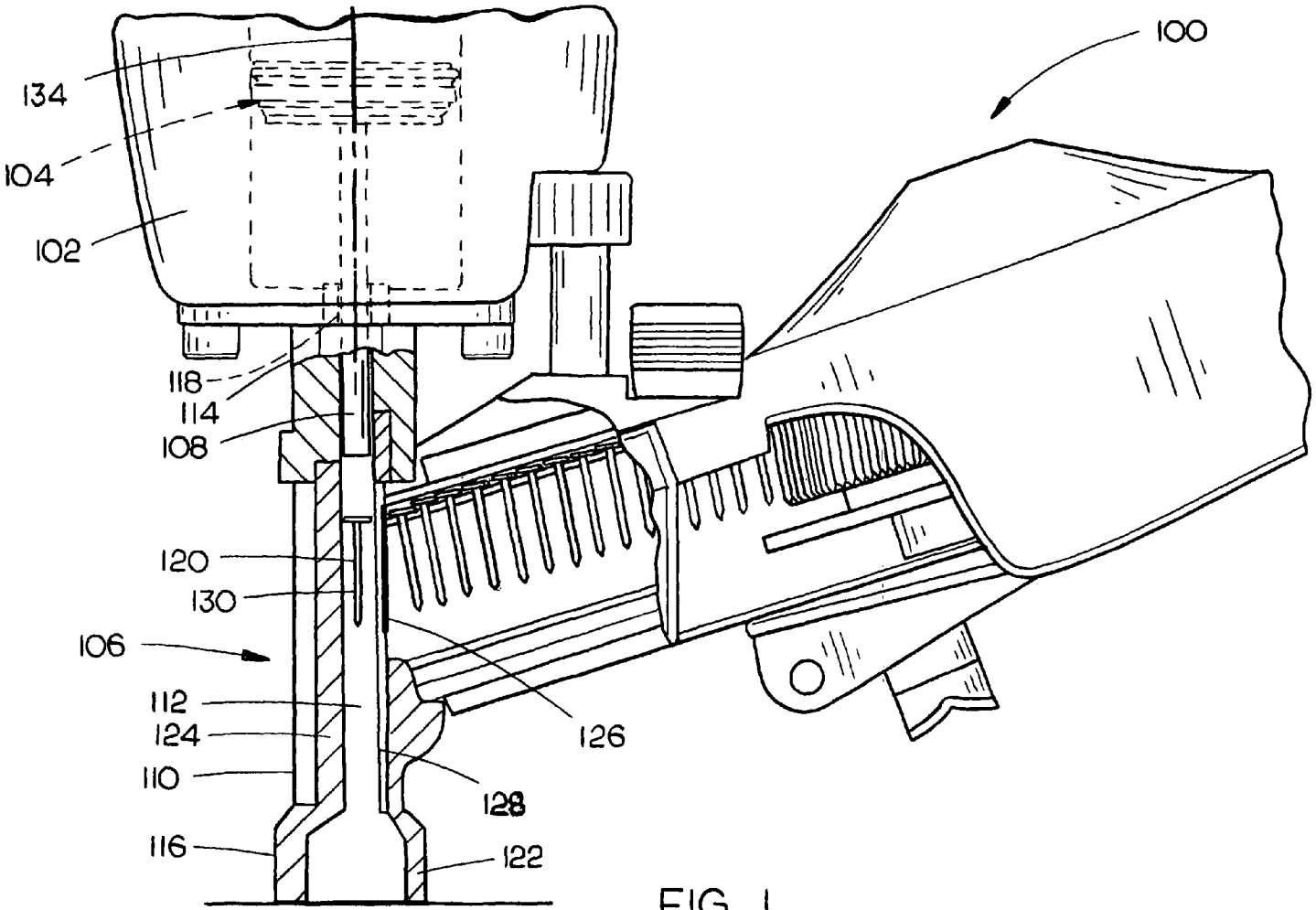
FIG. 1 is a cutaway view of a pneumatic fastener in accordance with an exemplary embodiment of the present invention.
Figure 2:
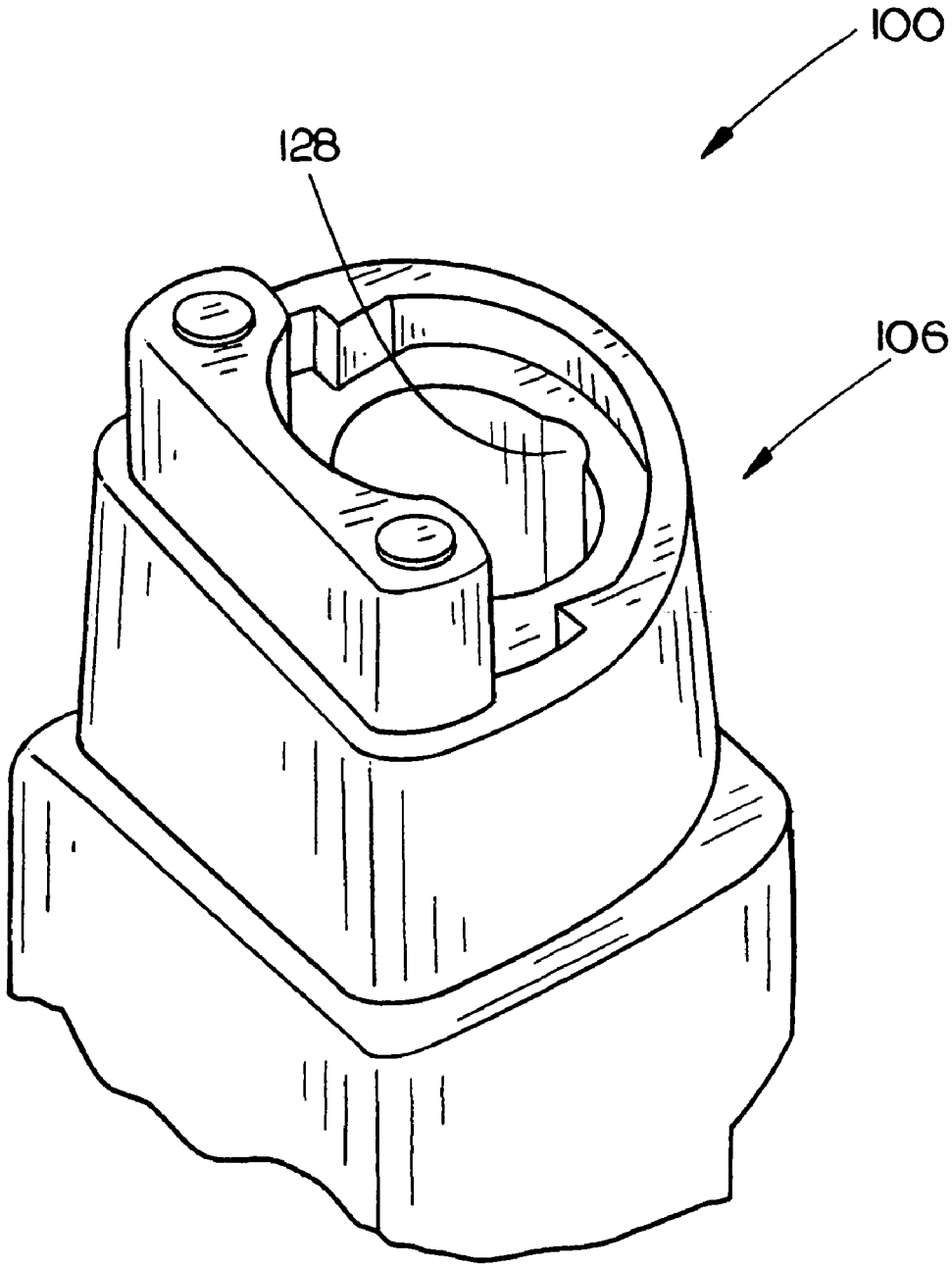
FIG. 2 is a perspective view of a nose casting assembly for a pneumatic fastener, in accordance with an exemplary embodiment of the present invention.

Reference will now be made in detail to the presently preferred embodiments of the invention, examples of which are illustrated in the accompanying drawings.

Referring generally now to FIGS. 1 through 7C, exemplary embodiments of the present invention are shown. In a present embodiment, a pneumatic fastener 100 includes a housing 102, a piston 104, a nose casting assembly 106 and a driver blade 108. In an exemplary embodiment, (with specific reference to FIGS. 1 and 2) the pneumatic fastener 100 is a roofing coil nailer. In further embodiments, the pneumatic fastener may be a stapler, a framing nailer (FIG. 5), and the like.

In a present embodiment, the housing 102 of the pneumatic fastener 100 at least substantially contains the piston 104 for driving a driver blade 108. The nose casting assembly 106 includes a body 110 having a driver channel 112 formed therein for receiving the driver blade 108. The body 110 includes a first end 114 and a second end 116. The first end 114 of the body 110 is coupled to the housing 102 and includes an aperture 118 for allowing passage of the driver blade 108 into the driver channel 112. The second end 116 of the body 110 is configured for allowing a fastener 120 to be expelled from the nose casting assembly 106. Additionally, the body 110 includes an exterior surface 122 and an interior surface 124. The interior surface 124 includes a loading aperture 126 formed therein for allowing passage of a fastener 120 into the driver channel 112. The interior surface 124 further includes a nose casting groove 128 formed therein. The nose casting groove 128 is sized to provide clearance for an inverted nail shank 130 between the driver blade 108 and the interior surface 124 of the body 110 of the nose casting assembly 106. This is done so that, if a fastener becomes inverted from a desired orientation within the driver channel 112, the shank 130 of a fastener 120 may avoid becoming wedged between the driver blade 108 and the body 110. Thus, the nose casting groove 128 may allow a potentially jammed fastener 120 to exit the nose casting assembly 106 or permit easy removal by a user. The nose casting groove has such capability because it is configured to receive the shank 130 of a fastener so that the fastener 120 does not become wedged between the nose casting assembly 106 and the driver blade 108. The capability established by the nose casting groove 128 of the present invention may be particularly useful in situations where repetitive use of the pneumatic fastener 100 is needed.

Figure 3C:
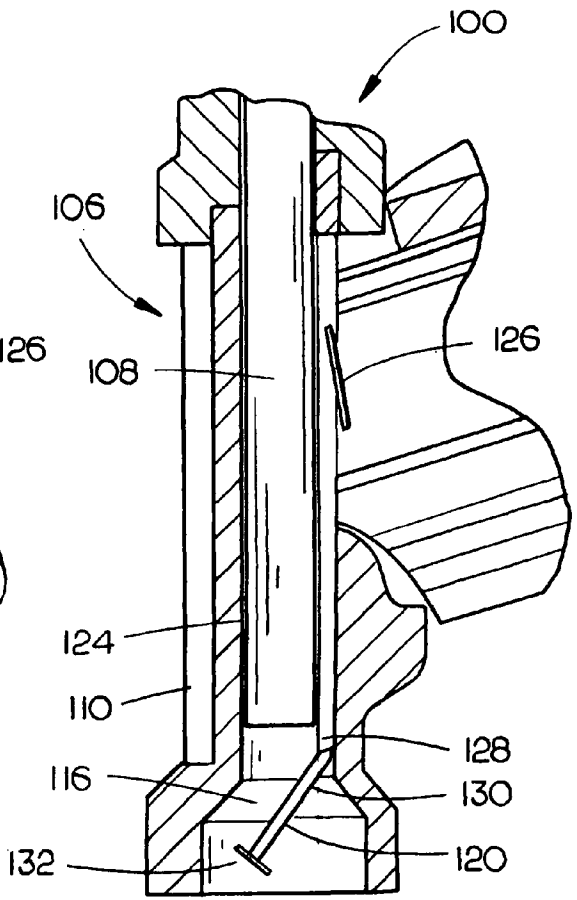
FIG. 3C illustrates the positioning of an incorrectly positioned fastener utilized with the pneumatic fastener of the present invention as the driver blade returns to a disengaged position.
Figure 3B:
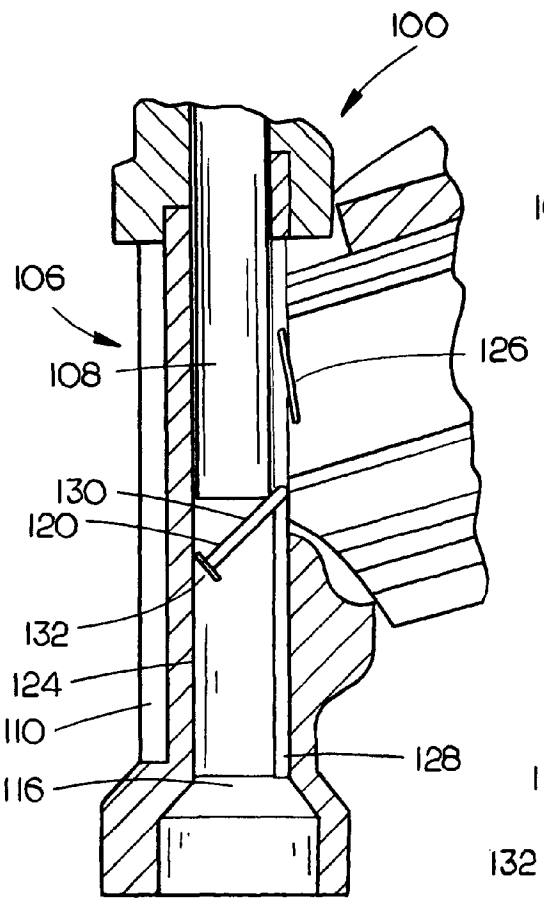
FIG. 3B illustrates an incorrect positioning of a fastener utilized with the pneumatic fastener of the present invention upon engagement of the fastener with the driver blade.
Figure 3A:
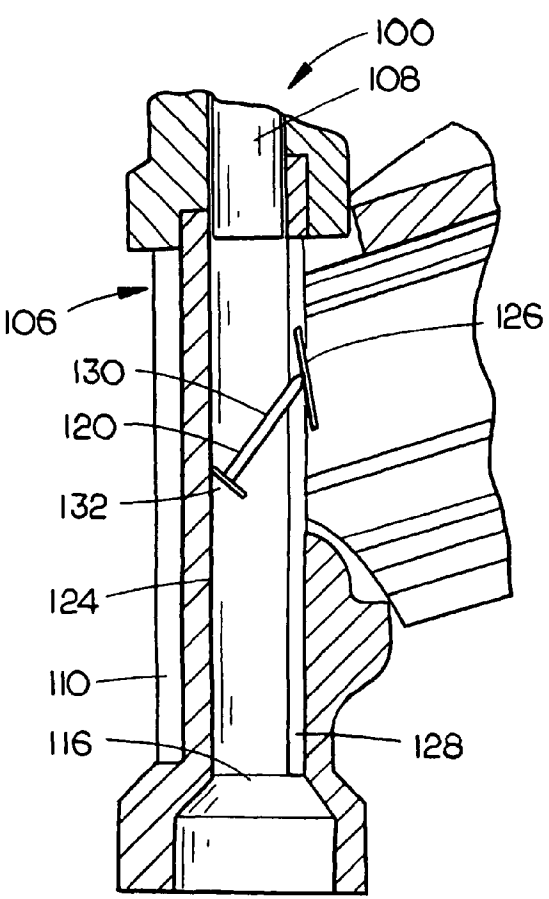
FIG. 3A illustrates an incorrect positioning of a fastener utilized with a pneumatic fastener of the present invention upon entry of the fastener into the driver channel.
Figure 4A:
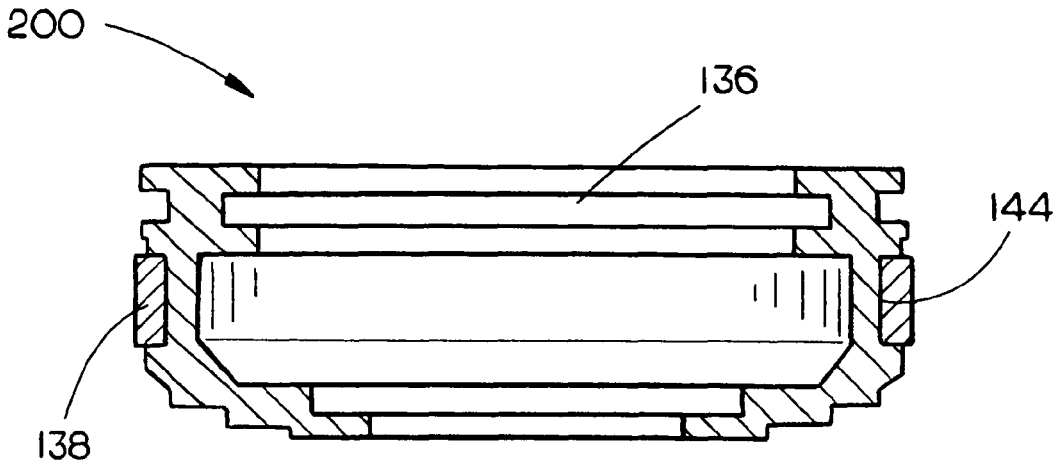
FIG. 4A is a sectional view of a firing valve including a split guide ring for a pneumatic fastener in accordance with an exemplary embodiment of the present invention.
Figure 4B:
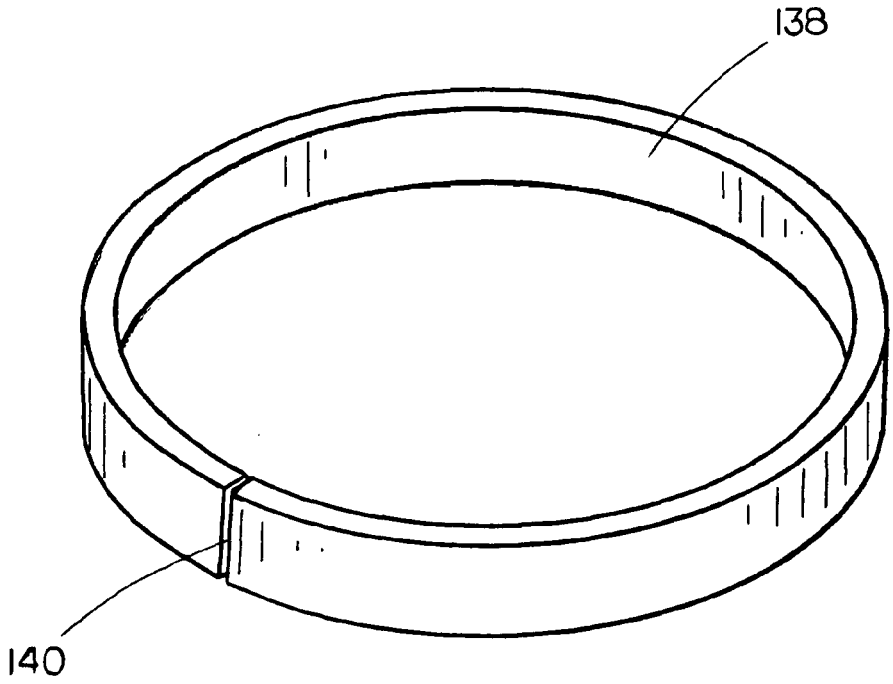
FIG. 4B is a sectional view of the split guide ring of FIG. 4A in accordance with an exemplary embodiment of the present invention.
Figure 5:
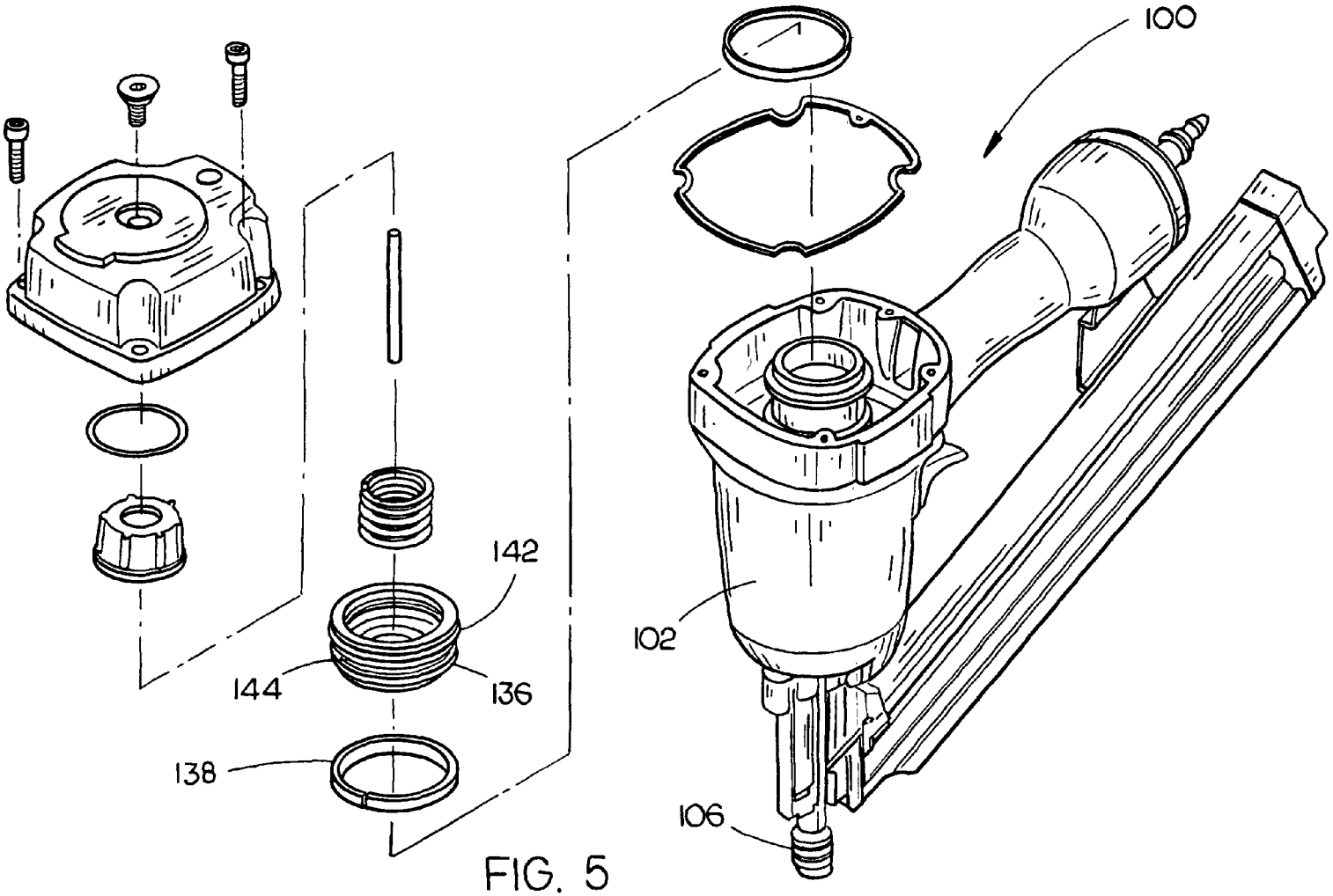
FIG. 5 is a cutaway view of a pneumatic fastener in accordance with an exemplary embodiment of the present invention.
Figure 6A:
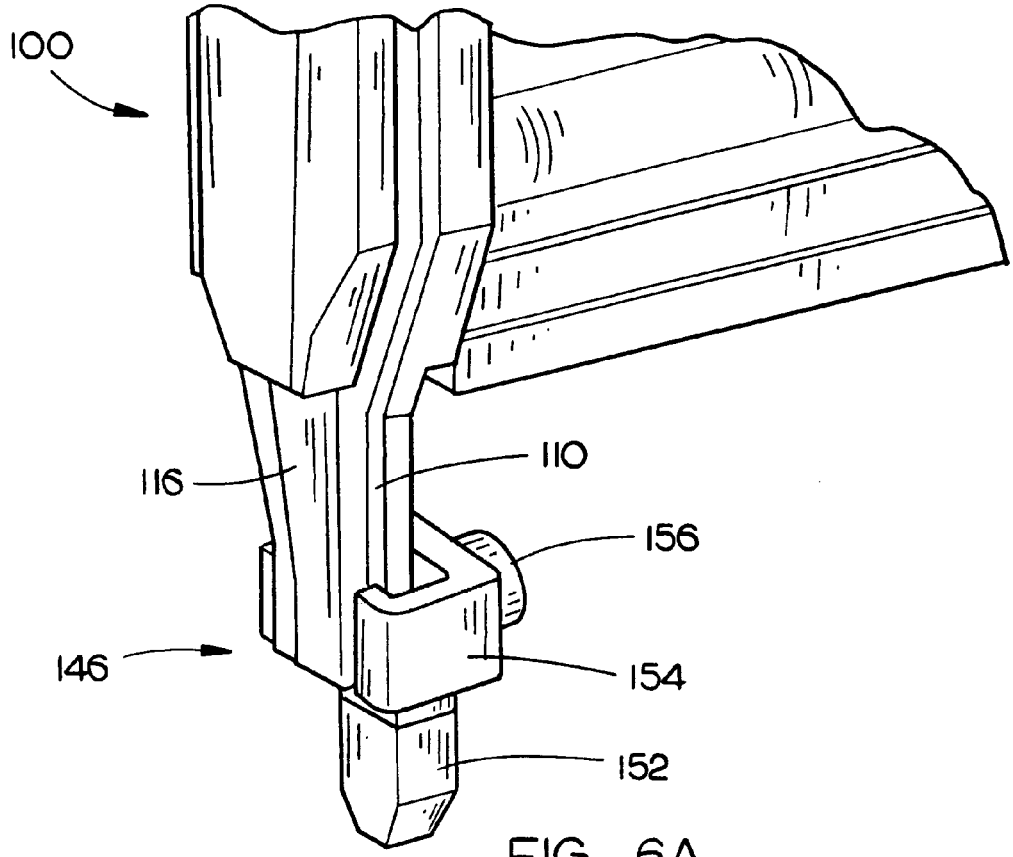
FIG. 6A is an illustration of a tip assembly for a pneumatic fastener in accordance with an exemplary embodiment of the present invention.
Figure 6B:
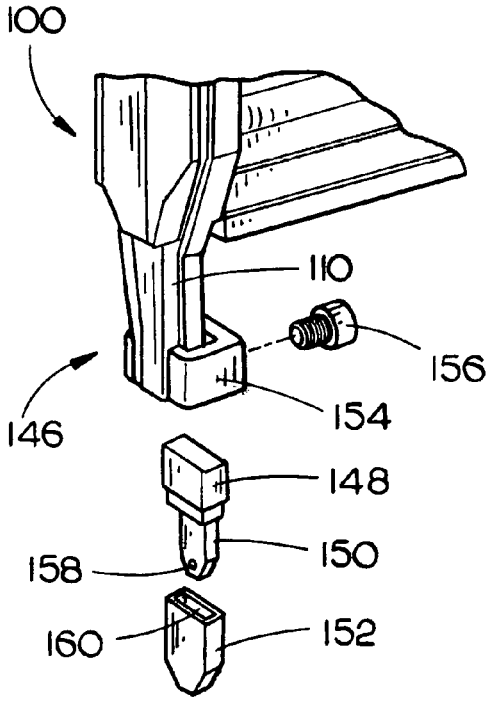
FIG. 6B is an illustration of a tip assembly for a pneumatic fastener in accordance with an exemplary embodiment of the present invention.
Figure 6C:
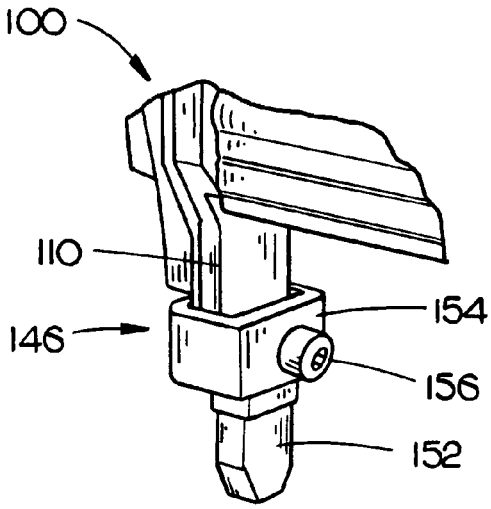
FIG. 6C is an illustration of a tip assembly for a pneumatic fastener in accordance with an exemplary embodiment of the present invention.
Figure 7A:
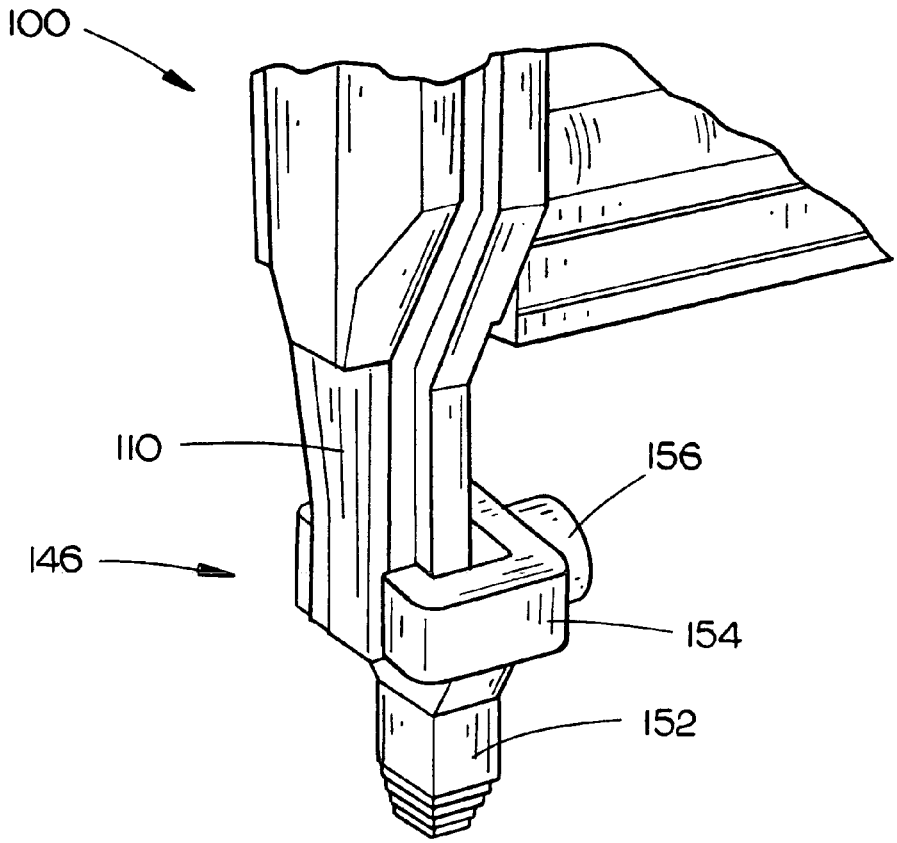
FIG. 7A is an illustration of a secondary tip member coupled with the tip assembly for a pneumatic fastener in accordance with an exemplary embodiment of the present invention.
Figure 7B:
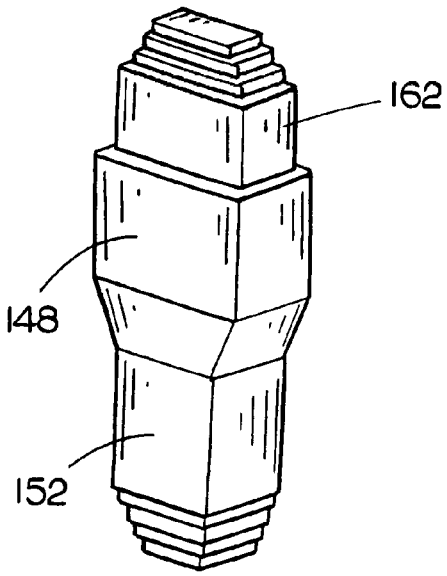
FIG. 7B is an illustration of a secondary tip member coupled with the tip assembly for a pneumatic fastener in accordance with an exemplary embodiment of the present invention.
Figure 7C:
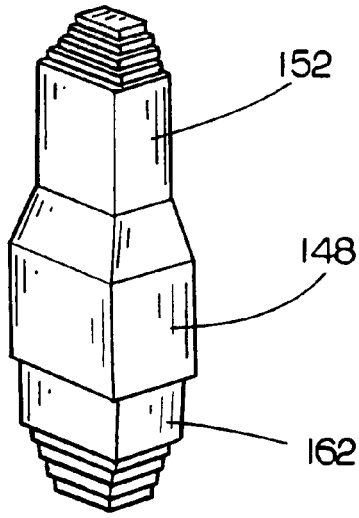
FIG. 7C is an illustration of a secondary tip member coupled with the tip assembly for a pneumatic fastener in accordance with an exemplary embodiment of the present invention.

FIGS. 3A-3C illustrate how the nose casting groove 128 is implemented in a roofing coil nailer 100 in accordance with an exemplary embodiment of the present invention. FIG. 3A shows a nail 120 within the driver channel 112, just after the user has fired the nailer 100. At this point, the nail 120 has been fed into the driver channel 112 via the loading aperture 126 and the driver blade 108 is moving downward towards the nail 120 to drive the nail 120. As often occurs when using a roofing coil nailer 100 and firing the last nail in a coil strip, the nail 120 has a tendency to invert as it falls down the driver channel 112. The nail 120 tends to invert because, being the last nail 120 in the coil, it has no other nails or collated coil wiring to hold it in place. This results in the nail 120 being incorrectly positioned (as shown) in that the shank 130, rather than the head 132 is positioned towards the driver blade 108. In FIG. 3B, when the nail 120 is incorrectly oriented, the driver blade 108 may engage with the shank 130 of the nail 120, driving the nail 120 against the interior surface 124 of the body 110 of the nose casting assembly 106 and downward towards the second end 116 of the body 110. However, the nose casting groove 128 of the interior surface 124 may receive the shank 130 of the nail 120 and allows the shank 130 to slide downward within the groove 128 towards the second end 116 of the body 110 of the nose casting assembly 106, thereby preventing the nail 120 from wedging within the nose casting 106. In FIG. 3C, as the driver blade 108 returns to an upward position, the nail 120 is permitted to fully exit the nose casting assembly 106. By preventing the nail 120 from becoming wedged, the nose casting groove 128 not only increases the efficiency of the pneumatic fastener 100, but also prevents damage to the pneumatic fastener 100 that may occur by improper removal.

Figure 8A:
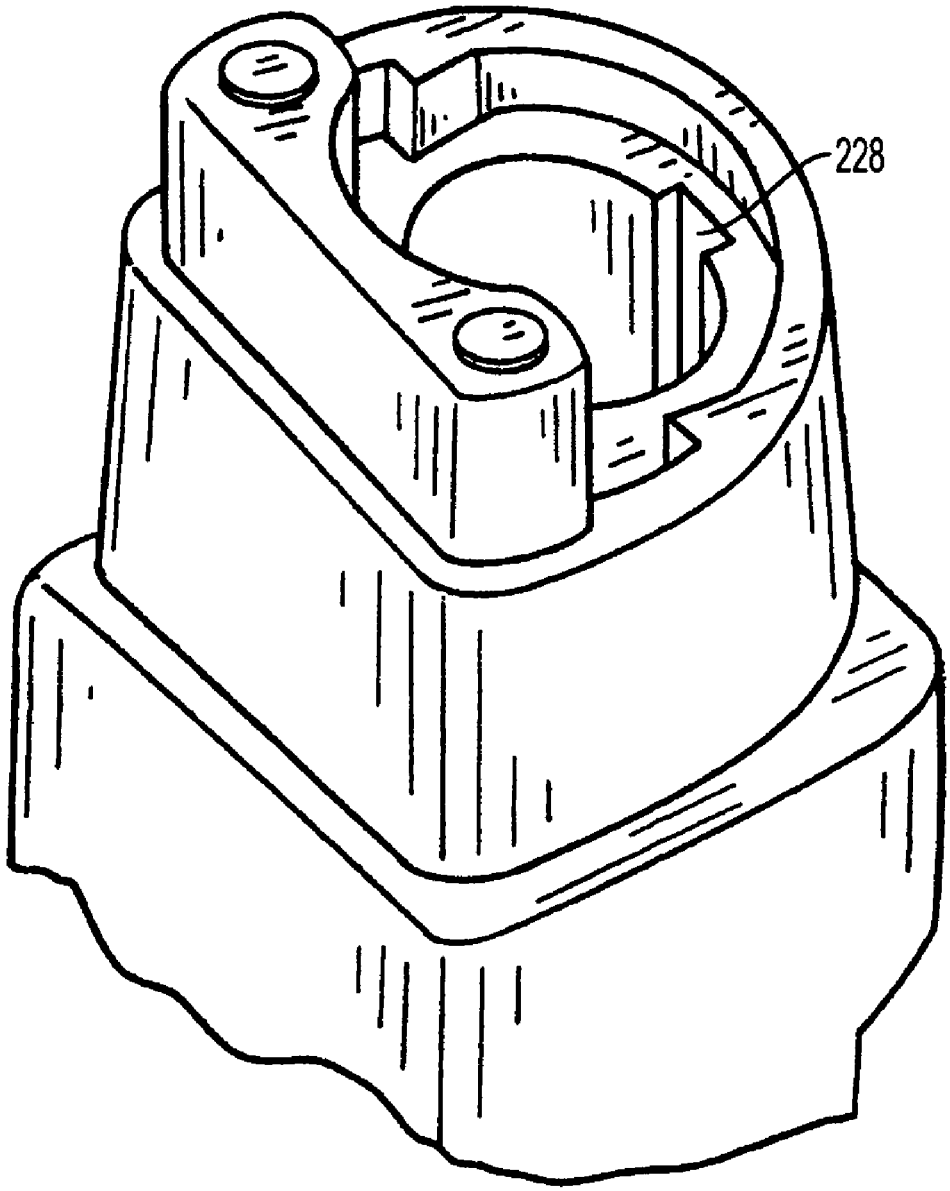
FIG. 8A is a perspective view of another embodiment of a nose assembly.

The nose casting groove 128 (shown in FIG. 2) may be formed in a variety of configurations and shapes. In exemplary embodiments, for example as shown in FIG. 8A, the nose casting groove 228 may be rectilinearly shaped. In further embodiments, the nose casting groove 128 is concave. Further the nose casting groove 128 may be machined into a steel nose casting body 110 or the nose casting groove may be molded within a plastic nose casting body 110. In a preferred embodiment, the nose casting groove 128 has a length of at least one-half inch and extends linearly along the interior surface 124 of the body 110 of the nose casting assembly 106 from an area proximal to the loading aperture 126 towards the second end 116 of the body 110. In exemplary embodiments, the nose casting groove 128 extends through the second end 116 of the body 110. In current embodiments, the nose casting groove's 128 depth, which is the distance the groove extends from the interior surface 124 towards the exterior surface 122, corresponds to the diameter of a shank 130 of a fastener 120 being employed with the pneumatic fastener 100. For example, a roofing coil nailer may use nails (i.e.—fasteners) with a shank diameter of approximately 0.120 inches. Therefore, the nose casting groove 128 for the roofing coil nailer may have a depth slightly greater, such as 0.130 inches, so that the nose casting groove 128 is configured for easily receiving the shank of the size of nail typically used with the roofing coil nailer. It is contemplated that the groove depth and length may be established in alternative configurations as contemplated by those of ordinary skill in the art.

Figure 8B:
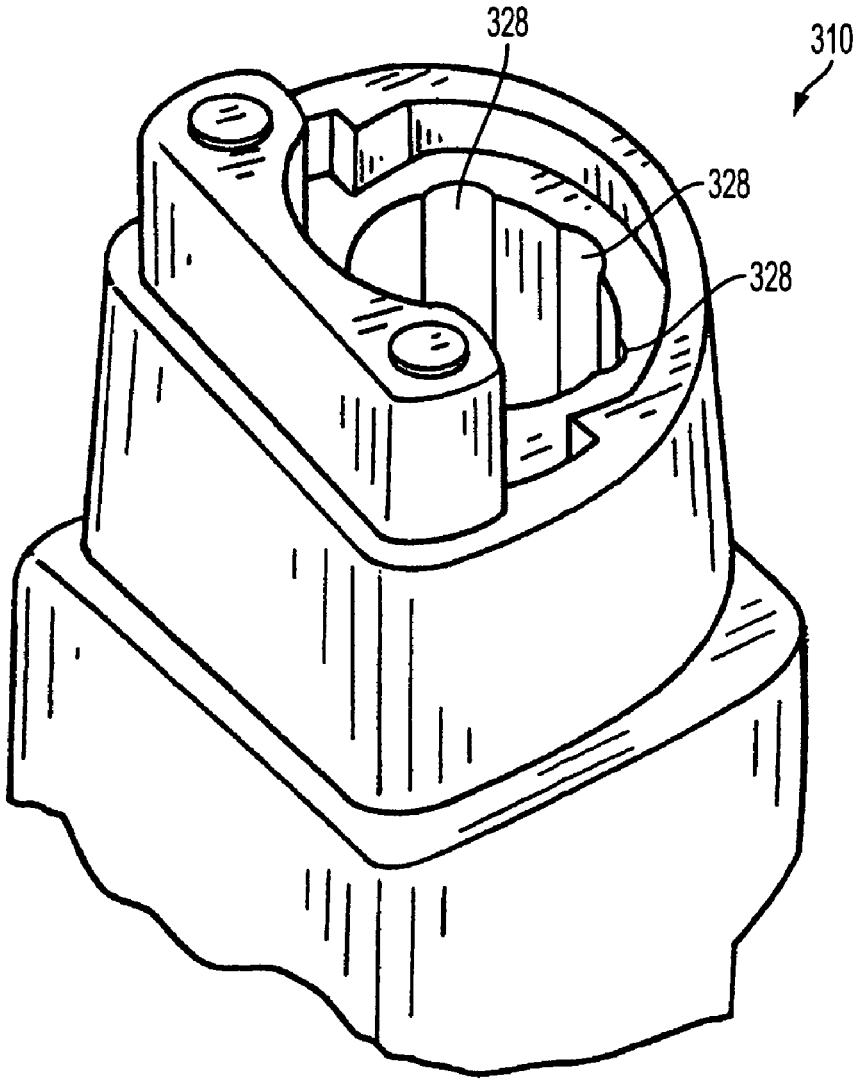
FIG. 8B is a perspective view of another embodiment of a nose assembly.

In further embodiments, for example as shown in FIG. 8B, the body 310 may include a plurality of nose casting grooves 328.

In current embodiments, the driver blade 108 of the pneumatic fastener 100 functions to drive a fastener 120. The driver blade 108 is coupled with a piston 104 and is configured for moving bi-directionally (i.e.—reciprocating) within the driver channel 112. The driver blade 108 may move axially along an axis 134 extending through the housing 102 and the driver channel 112.

In a further aspect, a pneumatic fastener 100 further includes a valve assembly 200. The valve assembly 200 includes a firing valve piston 136 coupled with a guide ring 138. (See FIGS. 4A, 4B and 5). In a preferred embodiment, illustrated in FIGS. 4A and 4B, the firing valve piston 136 is a shortened firing valve piston, such as a poppet firing valve piston, for minimizing the overall length of the pneumatic fastener 100, compared to current pneumatic fasteners. This may be advantageous in promoting the operation of the pneumatic fastener 100 in close quarters, such as in between studs in a wall. The poppet firing valve piston 136 may be formed of various materials, such as aluminum, other metals, plastics, or other rigid materials, as contemplated by those of skill in the art.

In an exemplary embodiment, the firing valve piston 136 is coupled with a split guide ring 138. In a current embodiment, the firing valve piston 136 includes an O-ring 142 and a groove 144 disposed within the outer surface of the firing valve piston 136 for coupling with the guide ring 138. The guide ring 138 couples with the groove in such a manner that the guide ring 138 protrudes from the groove of the firing valve piston 136. The guide ring 138 defines a seam 140 which transverses the groove 144 of the firing valve piston 136. The seam 140 of the guide ring 138 permits pressurized air to escape from and be vented about the valve assembly 200, such as from an area between the O-ring 142 and the guide ring 138. Current valve assemblies have used poppet firing valve pistons utilizing two O-rings on their outer diameter. The problem with such assemblies is that pressurized air may accumulate between the two O-rings, leading to valve piston sticking. The valve assembly 200 of the present invention solves this problem because the seam 140 of the guide ring 138, prevents pressurized air from accumulating between the O-ring 142 and the guide ring 138, thereby minimizing valve piston sticking and thus, increasing the efficiency and useful life span of a pneumatic fastener 100 within which the valve assembly 200 may be implemented. Further, the O-ring 142 and the guide ring 138 of the firing valve piston 136 may promote improved valve assembly alignment within a pneumatic fastener 100. Additionally, the split guide ring 138 keeps debris out of the valve assembly 200 and eliminates the need to machine vent holes into the valve assembly to relieve pressure build up, therefore eliminating complex machining of the components.

In exemplary embodiments, the guide ring 138 may be composed of various plastics, such as polyethylene, and the like. It is further preferred that the plastic be an acetal which includes compounds that are characterized by the grouping $C(OR)_2$, such as Delrin®, a registered trademark owned by the E.I. du Pont de Nemours and Company. Such composition provides the firing valve piston 136 with a reduced frictional coefficient. For example, an acetal such as Delrin® is a lubricious plastic providing a surface which may reduce the amount of turbulence/friction involved with the travel of the guide ring 138, thereby minimizing valve piston sticking over current systems. Further, the use of plastics in producing the guide ring 138 may increase production efficiency.

In a further aspect, as shown in FIGS. 6A-7C, the pneumatic fastener 100 includes a tip assembly 146. The tip assembly 146 may increase the operational capabilities of the pneumatic fastener 100 and assist in avoiding unwanted marring of a workpiece. Toe nailing is a common term used for describing the fastening/securing in place of a workpiece when a nail is being driven by a pneumatic nailer at an angle other than generally perpendicular to the surface of the workpiece. The tip assembly may be included as a positioning tip or included on a sliding contact safety for permitting sequential or bump firing of a pneumatic fastener.

In exemplary embodiments, the tip assembly 146 includes a mount member 148, an extension member 150 coupled with the mount member 148, and a tip 152 coupled with the extension member 150. Further, the tip assembly 146 includes a sleeve 154 including a sleeve receiver for connecting with a fastener 156. In a preferred embodiment, the sleeve 154 couples with the body 110 of the nose casting assembly 106 of the pneumatic fastener 100, proximal to the second end 116 of the body 110, the second end 110 being the end from which a fastener 120 is driven out of the pneumatic fastener 100. The mount member 148 is inserted within the sleeve 154, the mount member 148 further including a mount receiver 158. The mount member 148 inserts within the sleeve 154 and aligns the mount receiver 158 with the sleeve receiver. The alignment of the sleeve receiver and mount receiver 158 enables a fastener to connect with both the sleeve 154 and the mount member 148. The fastener 156 secures the mount member 148 within the sleeve 154.

In a preferred embodiment, the mount member 148 and extension member 150 are composed of the same material. In a current embodiment, they are composed of steel. However, the material composition of the mount member 148 and extension member 150 may include various other metals, rigid plastics, rigid composites, and the like. Further, the current embodiment establishes the mount member 148 and extension member 150 as integral with one another. Alternatively, the extension member 150 may be connected with the mount member 148 through the use of fasteners, such as a bolt, clip, screw, pin, and the like. In additional embodiments, the extension member 150 connects with the mount member 148 through the use of one or more mechanisms, such as a compression lock assembly, latch assembly, friction fit assembly, and the like. The connection of the extension member 150 with the mount member 148 enables the extension member 150 to be removed from the mount member 148. In embodiments where the extension member 150 is enabled to be removed from the mount member 148, one or more secondary extension members and/or mount members may be included to replace the extension member 150 and/or mount member 148 of the current embodiment. It is contemplated that the secondary extension members and mount members may be differently configured than those of the current embodiment.

In current embodiments, the extension member 150 is coupled with the mount member 148 and extends a distance from the mount member 148. The extension member 150 further couples with the tip 152, presenting the tip 152 in a position whereby during operation of the pneumatic fastener 100, the tip 152 will contact a workpiece, such as a piece of molding. In a preferred embodiment, the tip 152 includes an extension receiver 160 formed via a molding process for coupling with the extension member 150.

In further embodiments, the tip 152 is integral with the extension member 150. Alternatively, the tip 152 is enabled to be removed from the extension member 150. In embodiments where the tip 152 is enabled to be removed from the extension member 150, one or more secondary tips are included for replacing the tip 152 when the tip 152 has reached the end of its useful life span. It is further contemplated that the ability to remove and replace the tip 152 may require the use of tools or alternatively, may be removed and replacement without requiring the use of tools.

The tip 152 may be variously configured as contemplated by those of ordinary skill in the art. In a preferred embodiment, the tip 152 is contoured to a narrow tip configuration which may accommodate positioning the pneumatic fastener 100 at various angles, for performing functions such as toe nailing or the like. The length and width of the tip 152 may be established in a variety of manners in order to enable the functionality of the tip 152. In a preferred embodiment, the length and width of the tip 152 enables it to be established within a location which is angled at 90°, such as at a juncture of two pieces of trim woodworking. It is contemplated that the length and width of the tip 152 may be varied to accommodate different pneumatic fasteners.

The tip 152 may be composed of materials which are durable and provide a degree of flexibility for maneuverability in close quarters. In a preferred embodiment, the tip 152 is a compact steel tip overmolded with rubber or an elastomeric material so as to minimize slippage of the tip from the workpiece. It is understood that the rubber overmolding for the tip 152 further provides assistance in preventing the marring of a work surface. The tip of the preferred embodiment may provide a sufficiently durable tip 152 but still provide a degree of flexing or stretching to the user to promote maneuverability and prevent inadvertent slippage of the tip 152. It is contemplated that the material used may vary as contemplated by those of skill in the art. Other materials, such as various other plastic resins and composites, which provide similar durability and flexibility, may be employed without departing from the scope and spirit of the present invention.

In an alternative embodiment, the tip assembly 146 includes a mount member 148, substantially similar to that shown and described above, except that the mount member 148 is coupled on an end, opposite the end coupled with the extension member 150 and tip 152, with a secondary tip member 162. In a preferred embodiment, the mounting member 148 including the extension member 150 coupled with the tip 152 and the secondary tip member 162 is enabled as a two-position member. A first position enables the functionality of the tip 152 by orienting the tip 152 to contact a work surface during the operation of the pneumatic fastener 100. A second position is achieved by reversing the orientation of the mounting member 148 from that established in the first position. This reversed orientation enables the secondary tip member 162 to contact the work surface during the operation of the pneumatic fastener 100. This two-position capability of the mounting member 148 is enabled through the use of the fastener 156 engaging with the mounting receiver 158 and the sleeve receiver (not shown), as described previously. Other mechanical connection systems, such as a compression lock assembly, latch assembly, friction fit assembly, may be employed to enable the two-position functionality of the mounting member 148 without departing from the scope and spirit of the present invention.

In current embodiments, the secondary tip member 162 is contoured in a similar manner as that of the tip 152. Alternatively, the secondary tip member 162 is contoured differently than the tip 152. It is contemplated that the length and width of the secondary tip member 162 may be changed to accommodate the needs of different pneumatic fasteners. In a preferred embodiment, the secondary tip member 162 is composed of a material, such as steel, which is sufficiently rigid to enable a user of the pneumatic fastener 100 to slide the secondary tip member 162 along a workpiece without the tip member 162 gripping the workpiece. This may be useful in production situations where a user may need to slide a nailer along a surface to secure multiple fasteners quickly and surface marring is not an issue. In further embodiments, the secondary tip member 162 is composed of similar material as that of the mounting member 148. Alternatively, the secondary tip member 162 may be composed of various other metals, rigid plastics, and composites, as contemplated by those of skill in the art. The secondary tip member 162 may promote the efficient operation of the pneumatic fastener without departing from the scope and spirit of the present invention.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof.

What is claimed is:

1. A nose casting assembly for a pneumatic fastener, comprising:

a body having a driver channel formed therein for receiving a driver blade, the body having a first end including an aperture therein for allowing passage of a driver blade into the channel, the body further including a second end configured for allowing a fastener to be expelled from the nose casting assembly, the body further having an exterior surface and an interior surface, the interior surface including a loading aperture formed therein for allowing passage of a fastener into the driver channel, the interior surface further having a nose casting groove formed therein, the nose casting groove extending linearly along the interior surface of the body towards the second end of the body, wherein the nose casting groove is configured for receiving the shank of a fastener being utilized with the pneumatic fastener for preventing the fastener from becoming wedged between the driver blade and the interior surface of the nose casting assembly when a shank of a fastener is oriented toward the driver blade.

2. A nose casting assembly as claimed in claim 1, wherein the nose casting groove extends linearly from an area proximal to the loading aperture towards the second end of the body.

3. A nose casting assembly as claimed in claim 1, wherein the nose casting groove extends linearly from an area proximal to the loading aperture through the second end of the body.

4. A nose casting assembly as claimed in claim 1, wherein the nose casting groove has a length of at least one-half inch.

5. A nose casting assembly as claimed in claim 1, wherein the nose casting groove has a depth that is at least equal to a diameter of a shank of a fastener being utilized with the nose casting assembly.

6. A nose casting assembly as claimed in claim 1, wherein the nose casting groove is rectilinearly shaped.

7. A nose casting assembly as claimed in claim 1, wherein the nose casting groove is concave.

8. A nose casting assembly as claimed in claim 1, wherein the nose casting assembly is steel and the nose casting groove is a machined groove.

9. A nose casting assembly as claimed in claim 1, wherein the nose casting assembly is plastic and the nose casting groove is a pre-molded groove.

10. A nose casting assembly as claimed in claim 1, wherein the inner surface of the body of the nose casting assembly includes at least two nose casting grooves disposed therein.

11. A pneumatic fastener, comprising:

a housing;

a nose casting assembly including a body having a driver channel formed therein for receiving a driver blade, the body having a first end coupled to the housing, the first end including an aperture for allowing passage of a driver blade into the channel, the body further having a second end configured for allowing a fastener to be expelled from the nose casting assembly, the body further having an exterior surface and an interior surface, the interior surface having a loading aperture formed therein for allowing passage of a fastener into the driver channel, the interior surface further having a nose casting groove formed therein, the nose casting groove extending linearly along the interior surface of the body from an area proximal to the loading aperture towards the second end of the body; and a driver blade for driving a fastener, the driver blade coupled to a piston, the driver blade being configured for moving bi-directionally within the channel along an axis extending through the housing and the channel, wherein the nose casting groove is sized for receiving the shank of a fastener being utilized with the pneumatic fastener for preventing the fastener from becoming wedged between the driver blade and the interior surface of the nose casting assembly when a shank of a fastener is oriented toward the driver blade.

12. A pneumatic fastener as claimed in claim 11, wherein the nose casting groove extends linearly from an area proximal to the loading aperture through the second end of the body.

13. A pneumatic fastener as claimed in claim 11, wherein the nose casting groove has a length of at least one-half inch.

14. A nose casting assembly as claimed in claim 11, wherein the nose casting groove has a depth that is at least equal to a diameter of a shank of a fastener being utilized with the nose casting assembly.

15. A nose casting assembly as claimed in claim 11, wherein the nose casting groove is rectilinearly shaped.

16. A nose casting assembly as claimed in claim 11, wherein the nose casting groove is concave.

17. A nose casting assembly as claimed in claim 11, wherein the nose casting assembly is steel and the nose casting groove is a machined groove.

18. A nose casting assembly as claimed in claim 11, wherein the nose casting assembly is plastic and the nose casting groove is a pre-molded groove.

19. A nose casting assembly as claimed in claim 11, wherein the inner surface of the body of the nose casting assembly includes at least two nose casting grooves disposed therein.

20. A nose casting assembly for a pneumatic fastener, comprising:

a means for receiving a driver blade, the driver blade receiving means including a means for allowing passage of a driver blade into the driver blade receiving means, the driver blade receiving means further including a means for allowing a fastener to be expelled from the nose casting assembly, the driver blade receiving means further including a means for allowing passage of a fastener into the driver blade receiving means, the driver blade receiving means further including a means for receiving a shank of a fastener, wherein the shank receiving means is configured for receiving the shank of a fastener being utilized with the pneumatic fastener for preventing the fastener from becoming wedged between the driver blade and the driver blade receiving means when a shank of a fastener is oriented toward the driver blade.

* * * * *